United States Patent [19]

Hofmann et al.

[11] Patent Number: 4,577,789

[45] Date of Patent: Mar. 25, 1986

[54] DEVICE FOR SEVERING SETS OF ENDLESS FORMS OR THE LIKE

[75] Inventors: Horst Hofmann; Jürgen Reckert, both of D-Prien am Chiemsee, Fed. Rep. of Germany

[73] Assignee: Systemform Datenbelege GmbH, D-Prien am Chiemsee, Fed. Rep. of Germany

[21] Appl. No.: 572,671

[22] PCT Filed: May 13, 1983

[86] PCT No.: PCT/DE83/00089

§ 371 Date: Jan. 12, 1984

§ 102(e) Date: Jan. 12, 1984

[87] PCT Pub. No.: WO83/04013

PCT Pub. Date: Nov. 24, 1983

[30] Foreign Application Priority Data

May 14, 1982 [DE] Fed. Rep. of Germany ..... 3218304

[51] Int. Cl.[4] ..... B65H 35/10

[52] U.S. Cl. ..... 225/100; 270/52.5

[58] Field of Search ..... 225/100, 101, 5, 4; 270/52.5

[56] References Cited

U.S. PATENT DOCUMENTS

| | | | |
|---|---|---|---|
| 1,605,642 | 11/1926 | Blecker . | |
| 2,278,424 | 1/1957 | Hageman et al. | 225/100 |
| 3,338,487 | 8/1967 | Schutz | 225/100 |
| 3,481,520 | 12/1969 | Pickering | 225/100 X |
| 3,484,031 | 12/1969 | Pine | 225/100 |
| 3,860,234 | 1/1975 | Parenti et al. | 271/263 |
| 3,972,283 | 8/1976 | Jennings | 270/52.5 X |
| 4,025,023 | 5/1977 | Moffitt | 225/100 |
| 4,118,022 | 10/1978 | Rayfield et al. | 225/100 X |
| 4,261,497 | 4/1981 | Roetter et al. | 225/100 |
| 4,284,221 | 8/1981 | Nagel et al. | 225/100 |

FOREIGN PATENT DOCUMENTS

| | | |
|---|---|---|
| 1552421 | 11/1968 | France . |
| 1598295 | 8/1970 | France . |
| 2175468 | 10/1973 | France . |
| 2185182 | 12/1973 | France . |
| 2329573 | 5/1977 | France . |
| 2039265 | 8/1980 | United Kingdom . |

*Primary Examiner*—Frank T. Yost

*Attorney, Agent, or Firm*—Toren, McGeady, Stanger, Goldberg & Kiel

[57] ABSTRACT

In a device for severing endless form sets (14) provided with transverse perforations, having a tear-off arrangement (22) of two transport roller pairs (72 and 74) arranged with spacing from one another it is proposed to drive the two transport roller pairs (72 and 74) at the same transport speed until the transverse perforation next to be torn apart has arrived between the two transport roller pairs (72 and 74). Now the drive speed of the forward roller pair (74) is doubled, which results in tearing open of the transverse perforation. The individual layers of the severed set piece are separated from one another by separator strips (30) and can be conveyed each into allocated reception boxes. The tear-off length desired in each case can be inserted manually into a control apparatus or alternatively, in the case of appropriate marking of the endless form set (14) can be read off with the aid of a detector (202).

32 Claims, 6 Drawing Figures

DEVICE FOR SEVERING SETS OF ENDLESS FORMS OR THE LIKE

The invention relates to a device for severing single-layer or multi-layer sets of endless forms or the like provided with transverse perforations, with a tear-off arrangement of two transporters arranged with spacing from one another in the transport path of the set, which may be formed by transport roller pairs holding the set between them, the forward transporter in the transport direction being drivable with higher speed than the rear transporter in order to generate, in the section of the set situated between the transporters, a tension stress instigating the tearing of one of the transverse perforations.

In a known device of this kind the two transporters each run at constant speed, the forward transporter running faster than the rear. As soon as the leading end of the set is grasped by the forward transporter, the latter exerts an increasing traction upon the length of the set between the two transporters, until finally the set tears in this region along a transverse perforation. The torn-off forward piece of the set is transported further by the forward transporter with the comparatively higher speed to a reception box, whereas the following leader end of the endless form set is moved with the lower speed to the forward transporter. As soon as this new leading end is grasped by the forward transporter a tension stress builds up again in the set, leading finally to the tearing off of the next piece of the set. The distance between the two transporters must here be adapted to the selected length of the set piece to be severed; the distance as a rule corresponds to this length, this is because in the case of a shorter distance the tension stress builds up too soon and the set tears off too soon, possibly on an intermediate transverse perforation.

On the other hand it is the problem of the invention to prepare a device of the initially stated kind which, without variation of the distance between the transporters, is suitable for the severing of endless form sets with different lengths of the pieces of the sets to be severed.

This problem is solved in that the transporters are drivable according to choice with the same and different speeds in dependence upon the position of the transverse perforation to be severed next. The transporters, which may be arranged at relatively short distance from one another, are driven at the same speed until the transverse perforation to be severed comes into the transporter region. Now the two transporters are driven at different speeds, namely the forward transporter at higher speed than the rear transporter. Consequently a tension stress builds up in the section of the set between the transporters, leading finally to the tearing apart of the set along the previously fixed transverse perforation. Now the two transporters can again be driven at the same speed until the transverse perforation to be severed next comes into the region of the transporters, and so forth. Accordingly set pieces of greatly differing lengths can be severed with one and the same transporter arrangement. The short distance between the two transporters results in an advantageously compact structural form of the device. It is also of special advantage that by reason of the possible short distance between the transporters it is ensured that the transverse perforation actually to be severed is exclusively situated between the transporters during the severing phase, whereas in the known device it is also possible for one or more intermediate transverse perforations to be arranged in this section, so that in the known device it is not impossible for the wrong transverse perforation to tear apart. Therefore the device according to the invention guarantees reliable severance function in each case at the predetermined position of the set.

In accordance with the invention an automatic operation of the device is also possible. In this case a control apparatus is provided to receive information as to the length of the set pieces to be severed and to emit speed command signals to the forward and/or rear transporter.

An automatic synchronisation of the device with the running of the set through the device is obtained by a first detector for the emission of a positional signal, indicating the exact position of the set, to the control apparatus. In a reliably working form of embodiment of especially simple construction it is provided that the first detector is arranged in the region between the perforation-tearing point and the forward transporter and is formed to measure the passing of the leading end of the set. In this case the detector can for example be a micro-switch; however a light barrier will be used for preference, as it works without wear.

In general, in a set of endless forms, the length of the set pieces to be severed is constant. This length is fed into the control apparatus at the beginning. In many cases however it is of great advantage if set pieces of different lengths can be severed from an endless form set. This is readily possible with the device according to the invention. For this purpose for example the control apparatus can be connected directly with the data processing installation which prints the endless form set. The data processing installation then delivers the mentioned information as to the length of the set pieces to be torn off from case to case to the control apparatus. However the device according to the invention for the severing of endless form sets can also be operated without direct connection to the data processing apparatus if a second detector is provided to read off a marking on the set, indicating the length of the set piece next to be torn off, and to deliver a corresponding severance length signal to the control apparatus.

Magnetic markings or mechanical markings (for example punched hole patterns) which can be read by appropriate detectors are conceivable. However an optical marking reader is preferred, since the corresponding markings can be printed at the same time in the production of the endless form set, without major expense.

In order to communicate the requisite information as to the momentary setting and speed of at least one of the transporters to the control apparatus a third detector is provided for the measurement of the momentary setting and/or speed of the forward and/or rear transporter and for emitting a corresponding setting and/or speed signal to the control apparatus. For the sake of simplicity the third detector can be formed by an inductive pick-up which scans a slotted disc or the like fitted fast in rotation preferably on the drive shaft and running in synchronism with the drive shaft of one of the transporters.

The lengths of the set pieces to be severed are usually stated in inches. A sufficiently accurate control is obtained if the division of the slotted disc corresponds to a transport length of 1/6 inch (25.4/6 mm.) each time.

Especially simple assembly of the control apparatus is guaranteed if the control apparatus comprises a counter which, upon the positional signal, begins to count the setting signals, and further a comparator circuit which, on reaching of a counting condition of the counter which is predetermined or derived from the severance length signal, delivers a speed command signal effecting the severance to the forward and/or rear transporter.

With mechanically simple means the object is achieved that, as desired, the transporters run according to choice with equal speeds and with different speeds if, as proposed according to the invention, the two transporters are coupled with one another through two alternately engageable gears with different transmission ratios. In the case of this arrangement a single drive motor suffices.

It is here proposed that one of the gears, the first gear, constantly couples the two transporters through a freewheel, and that the second gear is engageable according to choice, preferably by means of a magnetic coupling. Therefore for shifting between the two gears it is only necessary that the control apparatus should engage and disengage the magnetic coupling.

It is further proposed that one of the gears, preferably the first gear, is a 1:1 gear and the other gear is an approximately 1:2 gear. By reason of the relatively high transmission ratio of 1:2 one obtains a rapid severance of the pre-determined transverse perforation. The transport speed can therefore be relatively high. For the preferable case where the 1:1 gear is the first gear the magnetic coupling needs to be in operation only briefly, namely during the severing operation. For the automatic operation of the device according to the invention the control apparatus is connected with the magnetic coupling for the emission of an engagement signal, forming the speed command signal, to the magnetic coupling.

In the known device firstly the individual layers of the endless form set are separated from one another in a separator apparatus and then the individual (endless) layers are severed at their transverse perforations. In accordance with the invention both steps take place at the same time in one single arrangement. For this purpose it is provided that elongated separator members, preferably of strip form, arranged in each case between successive layers of the set, are provided which extend in the transport direction between a rear securing point behind the rear transporter and a forward securing point before the forward transporter. Thus the multi-layer set is moved to between the transporters and there severed as such along the mutually coinciding transverse perforations of the individual layers; however even before the multi-layer set is fed to the transporters a certain separation of the individual layers by the separator members extending to before the forward transporter takes place. Therefore the individual layers of the advancing set piece, separated after the tearing apart of the transverse perforations, can therefore be further used singly without problem, for example deposited in allocated compartments.

So that the separator members do not interface with the running of the transporters it is proposed that in each case at least one of the two transport rollers of each transporter extends perpendicularly of the transport direction only over a partial zone of the width of the set, preferably by division into at least two component rollers arranged with spacing from one another, and that the separator members extend through the transporters in the remaining region of the width of the set.

The separator members of strip form guide the layers of the form set reliably through the transporters if these are under spring initial stress and therefore always are in the extended condition.

The separation of the individual layers and subsequent feed into respectively allocated reception boxes is guaranteed if the forward securing points of the separator members are formed by separator heads. These separator heads can be provided with initial-stressing springs for the separator members of strip form.

The guidance of the layers through the transporters is further improved in that on at least one of the two sides of the set there is provided a cover member preferably of strip form which extends along the separator members.

In order to facilitate the tearing of the transverse perforation intended in each case, in the region between the transporters there is provided a preferably eccentrically mounted perforation-tearing aid with presser elements, preferably in the form of double-taper rollers, which press upon the set under local loading. The eccentric mounting renders possible an adaptation of the application pressure to the endless form set to be severed in each case.

In order to be able constantly to even out corrugations of the endless form set between the transport roller pairs, occurring during operation, it is provided that at least one of the two transport rollers or component rollers of each transporter is formed with a flattened partial region of the periphery.

It is frequently desired that the individual severed layer pieces should be free from marginal perforation strips. In this case it is proposed that before the two transporters there is provided a marginal strip removal apparatus for transport hole marginal strips of the set.

The device according to the invention is suitable for endless form sets of all kinds. Endless form sets of self-duplicating paper can be fed directly to the device according to the invention. In the case of endless form sets with duplicating interlayers, especially carbon paper interlayers, it is advisable not to conduct these interlayers with the set through the severing device, but to remove them previously. For this purpose it is proposed that before the two transporters and before the marginal strip removal device if present there is provided a device for conducting away interlayers, especially carbon paper interlayers, arranged between successive layers of the set.

The invention will be explained below by an example of embodiment with reference to the drawing, wherein.

Figure 1:
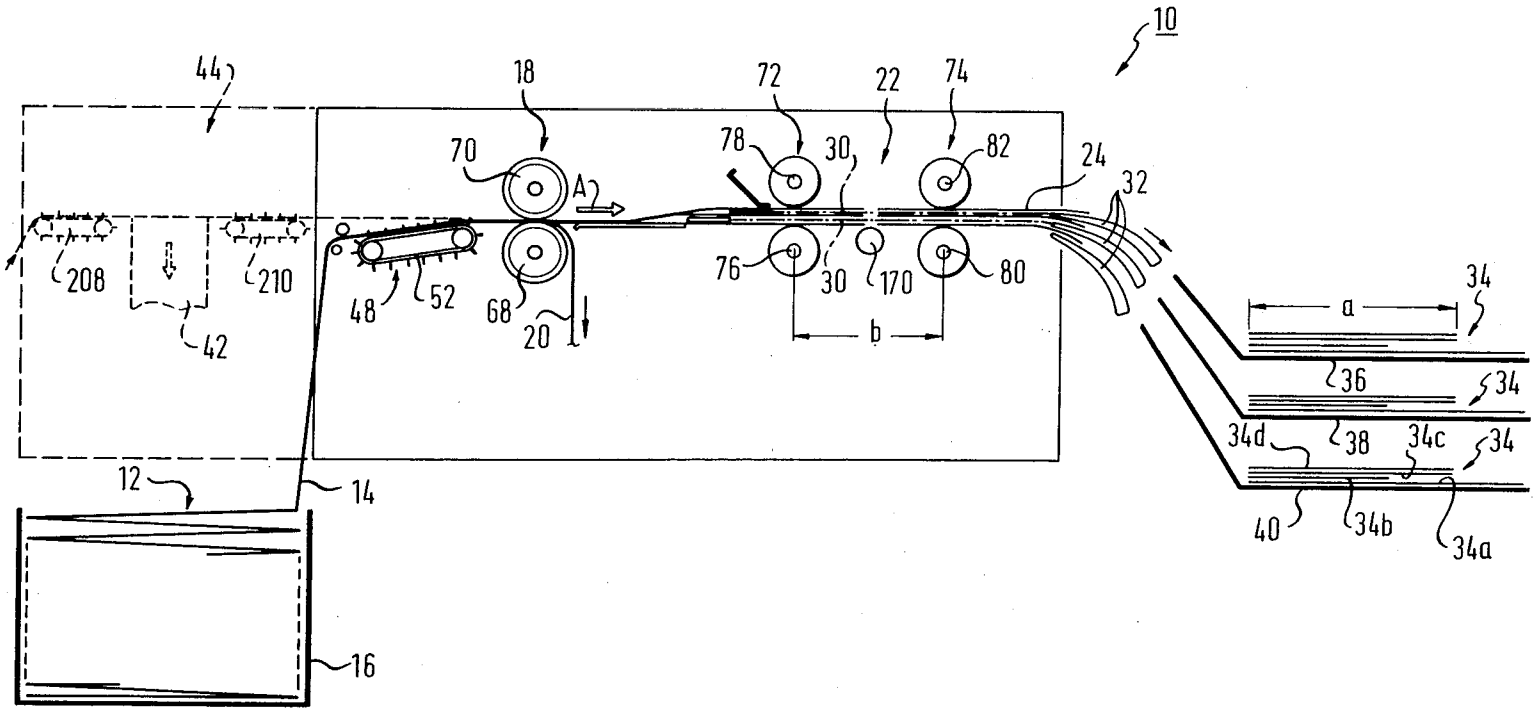
FIG. 1 shows a diagrammatic lateral elevation of a device according to the invention for severing endless form sets.

The device 10, represented diagrammatically in FIG. 1, for the severing of transversely perforated endless form sets serves for severing the endless form sets, delivered from an endless printer which may be connected to a data processing installation, into individual forms called set pieces. The device is suitable for single-layer or multi-layer endless form sets. In the case of multi-layer endless form sets a division of the individual layers of a set piece takes place.

Figure 2:
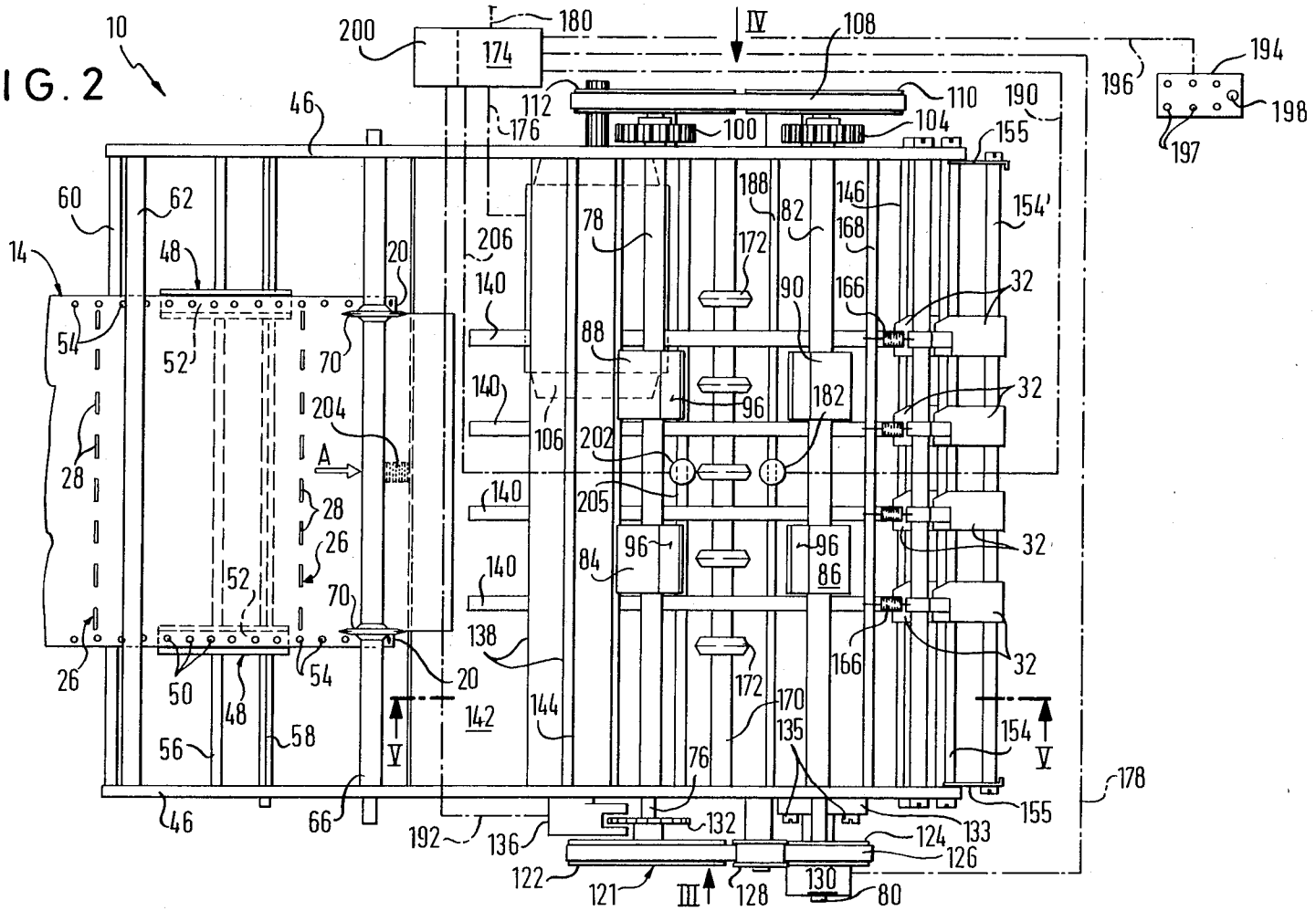
FIG. 2 shows a plan view, showing technical details, of a device according to FIG. 1.

On the left in FIG. 1 there is indicated a zig-zag stack or concertina-fold stack 12 of an endless form set 14 within a stack container 16. This endless form set 14 is guided firstly through a marginal strip removing apparatus 18 which removes transport hole marginal strips 20 extending on the lateral margins of the set 14. The marginal strip removal apparatus 18 will be explained in greater detail below by reference to FIGS. 2 and 3. The marginal strip removal apparatus 18 is followed by a tear-off arrangement 22 which ensures that endless form set pieces 24 are torn from the leading end of the set 14 along transverse perforations 26. These transverse perforations 26 are already present in the set 14 from the outset. In FIG. 2 there are indicated two such transverse perforations 26 in the form of slits 28. However the other usual types of perforations, such as punched-hole perforations, also come under consideration.

Figure 6:
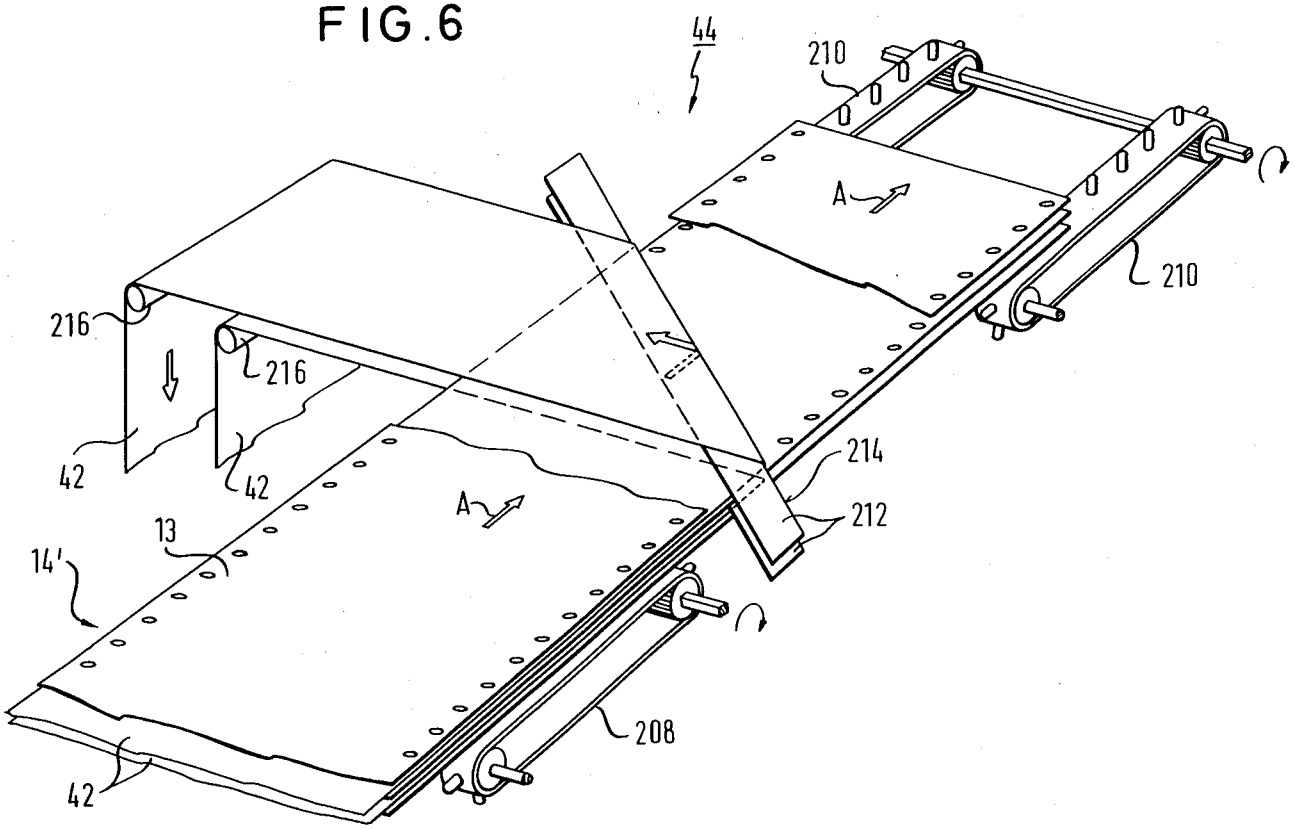
FIG. 6 shows an isometric representation of principle of a removal device for carbon paper interlayers which can be placed before the device according to FIGS. 2 to 5.

The tear-off arrangement 22 also provides for a separation of the individual layers, namely in that separator strips 30 are inserted between the individual layers. In FIG. 1 two such separator strips 30 are indicated in dot-and-dash lines. The leading ends, in the transport direction A of the set, of the separator strips 30 are fitted on separator heads 32 which deflect the individual set piece layers 34 into respectively allocated reception boxes 36, 38 and 40. Four already deposited set piece layers 34*a* to 34*d* can be seen in each reception box 36 to 40 in FIG. 1. As is seen, with the aid of the device according to FIG. 1 it is possible for set piece layers of different lengths a to be severed from the set 14. The layer 34*a* first separated has the greatest length; the layer 34*b* is half as long as the layer 34*a;* the length of the layers 34*c* and 34*d* amounts to $\frac{3}{4}$ of the length of the layer 34*a*. As will be described in greater detail further below, thus with the device according to the invention for example continuation invoices of different lengths can be severed or even what are called group separations of computer print-outs can be effected, that is to say a separation into set pieces allocated to the individual subscribers of a data processing installation (for example in the case of DATEV users). By the expression "endless form set" there is here quite generally understood a possibly printed, elongated, single-layer or multi-layer arrangement of paper or foil strips which are to be severed along prefabricated, transversely extending material attenuations. These can be self-duplicating paper sets in which duplication is effected on all layers, for example by reason of appropriate coatings on the front and rear of each inner layer. However with the device according to the invention it is also possible to handle duplicating paper sets in which duplicating interlayers, for example carbon paper interlayers, are necessary for the printing operation and then have to be removed again later however. The removal of such carbon paper interlayers 42 from the set 14 is carried out in a removal device 44 which can be placed before the marginal strip removal device 18 and is indicated in chain lines in FIG. 1. The removal device 44 will be explained in greater detail further below by reference to FIG. 6.

Figure 3:
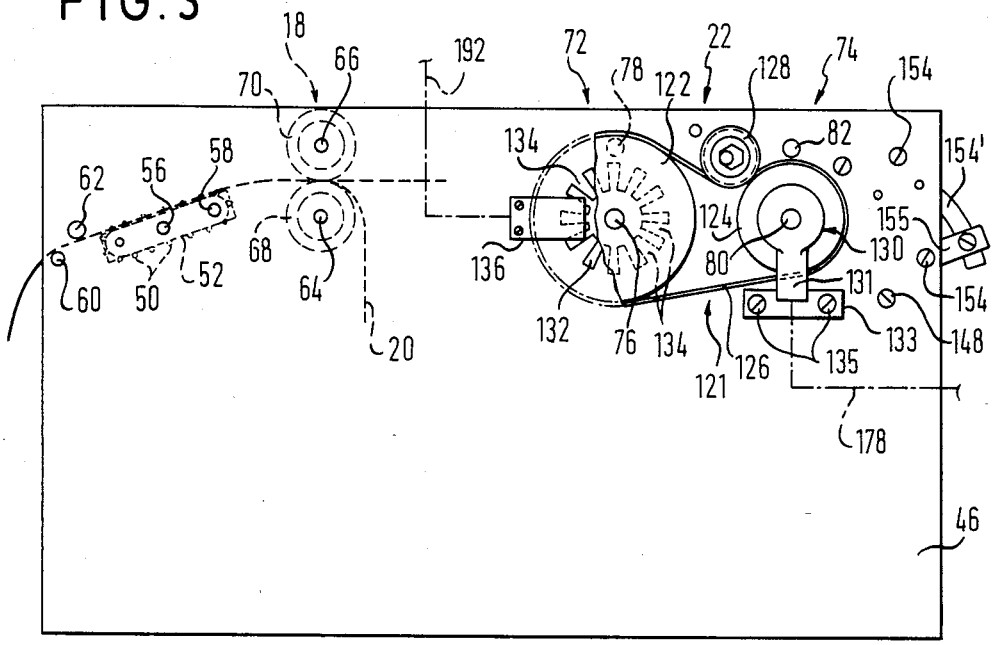
FIG. 3 shows a front elevation of the device according to FIG. 2, in the direction of the arrow III.
Figure 4:
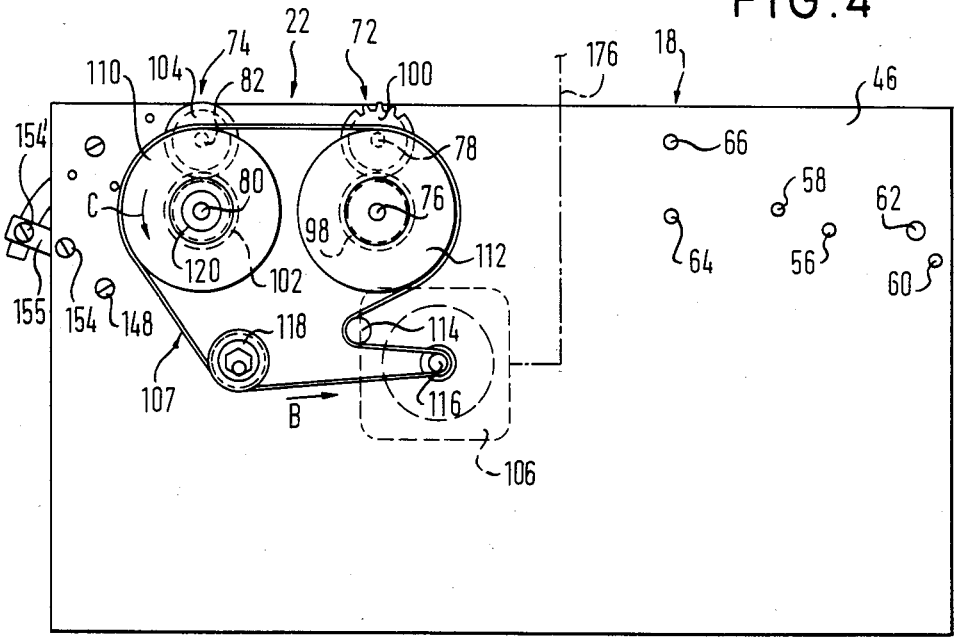
FIG. 4 shows a rear view of the device according to FIGS. 2 and 3 in the direction of the arrow IV in FIG. 2.

The device 10 as represented diagrammatically in FIG. 1 is represented in detail in FIGS. 2 to 4. The individual components of the device 10 are arranged on a row of horizontally extending parallel transverse bars which are mounted at both ends in two vertical side walls 46. The endless form set 14, coming from the left in FIGS. 2 and 3, is grapsed firstly by two pullers 48 which engage through caterpillar tracks 52 provided with knobs 50 in corresponding transport holes 54 on the two longitudinal margins of the set 14. In FIG. 2 a cross-bar 56 connecting the walls 46 can be seen, on which the pullers 48 are retained; a likewise transversely disposed square-ended shaft 58, which is set in rotation by a drive motor (not shown), drives the two pullers 48.

Before the set 14 reaches the pullers 48 it runs through between a lower and an upper guide rod 60 and 62 respectively, which likewise extend transversely between the walls 46.

The pullers 48 are adjoined in the transport direction A of the set 14 by the marginal strip removal apparatus 18 which is illustrated in simplified manner in FIGS. 2 and 3. Two cutter wheels 68 and 70 lying exactly one above the other are secured on each of the two shafts 64 and 66, which lie one above the other and are driven by drive means (not shown), in the region of each longitudinal margin of the set 14, which cutter wheels roll against one another with their external circumferences and in this way cut through the duplicating paper set, which may be multi-layer. In this way the marginal strip 20 containing the transport holes 54, on each of the two longitudinal sides of the set 14, is cut away, deflected downwards and deposited, for example rolled up, in a manner not illustrated. The shaft 64 and 66 can be mounted in the side walls 46 for displacement in the vertical direction in relation to one another, in a manner likewise not illustrated, in order to render possible a readjustment. Furthermore the shafts 64 and 66 can also be initially stressed in the direction towards one another by means of initial stressing springs.

Figure 5:
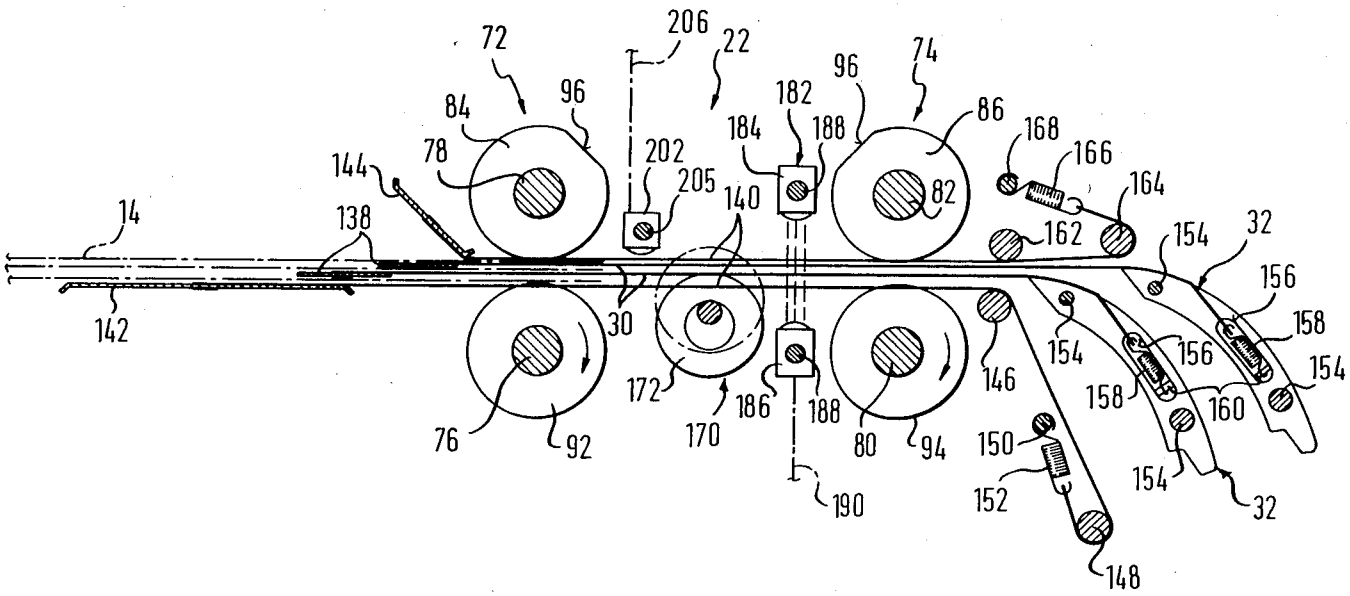
FIG. 5 shows a detail section of the device according to FIGS. 2 to 4 along the line V—V in FIG. 2, on an enlarged scale.

The marginal strip removal apparatus 18 is followed by the tear-off arrangement 22. This consists of two transport roller pairs 72 and 74 arranged at a distance b (see FIG. 1) from one another, which form a forward transporter in the transport direction (transport roller pair 74) and a rear transporter (transport roller pair (72). Each transport roller pair 72 and 74 consists of two roller shafts arranged vertically one above the other. The lower roller shaft of the transport roller pair 72 is to be indicated by 76 and the upper shaft by 78; the lower shaft of the transport roller pair 74 is to be indicated by 80 and the upper by 82. The shafts 76 to 82 each carry two component rollers spaced from one another. The forward component rollers, in FIG. 2, of the upper shafts 78 and 82 are designated by 84 and 86, the rear component rollers in FIG. 2 by 88 and 90. The rollers lying beneath the rollers 84 and 86 and visible in FIG. 5 are designated by 92 and 94. It can be seen from FIGS. 2 and 5 that the rollers lie in pairs one above the other and that the rollers of the rear transport roller pair 72 are in alignment in the transport direction A with those of the forward transport roller pair 74. As FIG. 5 especially shows, the upper component rollers 84 and 86 (also 88 and 90) are formed with a flattened partial zone 96 of the circumference which serves so that distortions of the multi-layer set 14 occurring during operation can be evened out. In fact as soon as the part circumferential zones 96, for example of the rollers 84 and 88, similarly oriented, are situated in their lowermost position, for the moment the set 14 is no longer clamped between the component rollers of the transport roller pair 72, so that the distortion can even itself out.

The component rollers, lying one above the other, of the forward transport roller pair 72 are driven in opposite directions and in synchronism. The synchronisation is achieved by the fact that the shafts 76 and 78 are each connected at their end protruding beyond the upper wall 46 in FIG. 2 fast in rotation with a gear wheel 98 and 100 respectively of a meshing pair of gears (see FIG. 4). In the same manner the shafts 80 and 82 of the forward transport roller pair 74 are synchronised with one another (meshing gear wheels 102 and 104 on the end of the shafts 80 and 82).

The drive of the two transport roller pairs 72 and 74 takes place from a single electric motor 106 which can be seen in FIGS. 2 and 4. The force transmission takes place through a belt drive 107. A belt 108, which may be a toothed belt, runs over two belt pulleys 110 and 112 of equal size which are fitted on the ends of the shafts 80 and 76 respectively protruding beyond the side wall 46. The belt 108 in the form of a closed loop runs from the belt pulley 112 to a reversing roller 114 and thence to the motor shaft 116 of the electric motor 106. Then the way leads over a tensioner roller 118 to the belt pulley 110 and back to the belt pulley 112. The transport direction of the belt 108 is indicated by the direction arrow B in FIG. 4. The belt pulley 112 is rigidly connected with the shaft 76. On the other hand the belt pulley 110 is coupled with the shaft 80 through a freewheel 120. The freewheel 120 can for example be inserted as freewheel ring into a correspondingly large central bore of the belt pulley 110 and pushed over the shaft 80. The freewheel 120 is arranged so that it blocks when the belt pulley 110 rotates at greater speed in the rotation direction C (counter-clockwise in FIG. 4) than the shaft 80. Thus in this case the shaft 80 is driven by the belt pulley 110. If on the other hand the shaft 80 seeks to rotate in the direction C at higher speed than the belt pulley 110, the freewheel 120 permits this.

Consequently if the two shafts 80 and 98 are driven exclusively by means of the belt pulleys 110 and 112, then the two transport roller pairs 72 and 74 run at the same speed (and in the same direction of rotation). The belt drive 107 represented in FIG. 4 therefore represents a 1:1 gear.

On the other side, represented in FIG. 3, of the device 10 a further belt drive 121 is fitted which represents an optionally engageable 1:2 gear. A large belt pulley 122 is fitted fast in rotation on to the end of the shaft 76 protruding from the side wall 46 at the bottom in FIG. 2. A small belt pulley 124 is carried on the corresponding end of the shaft 80. A belt 126 runs over the two belt pulleys 122 and 124 and additionally over an eccentrically mounted tensioner roller 128. Between the shaft 80 and the belt pulley 124 there is interposed a magnetic coupling 130, which is annular in this region and is provided with a downwardly protruding extension 131. The extension 131 is secured through a strap 133 by means of two screws 135 to the outer side of the wall 46. As long as the magnetic coupling 130 is not energised the belt pulley 124 and shaft 80 can run completely independently of one another. If on the other hand the magnetic coupling 130 is placed under an engaging voltage then it connects the shaft 80 fast in rotation with the belt pulley 124.

The belt drive 121 therefore constitutes an engageable gear the transmission ratio of which amounts, according to the ratio of the radii of the two belt pulleys 122 and 124, to 1:2.

Between the wall 46 and the belt pulley 122 a slotted disc 132 of metal is fitted fast in rotation on the shaft 76, the slots 134 of which disc are explored by an inductive pick-up 136 grasping in fork manner round the disc 132. The angular interval of successive slots 134 is determined so that to these there corresponds a transport distance of the set 14 through the transport roller pair 72 of 1/6 inch (25.4/6 mm.).

The separator strips 30, already mentioned in the explanation of FIG. 1, for the separation of the individual layers of the set 14 or of the severed set piece 24 are each fitted at their rear end, in relation to the transport direction A, on horizontal separator plates which again are fitted-in between the two side walls 46. The endless form set 14 used in the device 10 as represented in the Figures is of three layers. Therefore two separator plates 138 are provided each between two successive layers of the set 14 (see FIG. 5). In order that the set 14 or the set piece 24 severed at the front may be guided reliably through the tear-off arrangement 22, in addition to the separator strips 30 on the upper and under sides of the set 14 there are provided cover strips 140 which at their rear ends are again secured to plates connecting the walls 46. The lower cover strips 140 are secured to a lower plate 142, the upper cover strips 140 to an upper plate 144. The lower plate 142 is made as a relatively large support plate which protrudes relatively far oppositely to the transport direction A. The two transverse edges of the lower plate 142 are angled off slightly downwards. Approximately in the middle of the width (measured in the direction A) of the lower plate 142 the rear ends of the cover strips 140 are secured. As may be seen from FIG. 2, four cover strips 140 run away in the transport direction A from the lower plate 142. Two in each case of these cover strips 140 run past the two end faces of the forward two component roller pairs 92, 84 and 94, 86 in FIG. 2 (see also FIG. 5); the corresponding applies to the upper component roller pairs in FIG. 2, of which the component rollers 88 and 90 are recognisable. Adjoining the transport roller pairs 72 and 74, in the transport direction, a cross-bar 146 is provided which deflects the four lower cover strips 140 downwards to a second cross-bar 148. The ends of the four lower cover strips 140 are secured, with interposition of helical tension springs 152, to a further cross-bar 150.

Again four separator strips 30 are secured with their rear ends to the mentioned separator plates 138. These four strips 30 in each case extend exactly above the lower four cover strips 140, that is likewise parallel to the direction A and laterally past the component rollers. The forward ends of the total of eight separator strips 30 are secured to the already mentioned (likewise eight) separator heads 32. These separator heads 32 consist each of an elongated bent curve element pointed in wedge form in the lateral elevation in FIG. 5 at its rear end pointing towards the transport roller pairs 72, 74. The four separator heads 32 allocated in each case to the four separator strips 30 issuing from a separator plate 138 are retained in common on two cross-bars 154. Each separator head 32 is provided with a lateral recess 156 (see FIG. 5) to receive a helical tension spring 158 the one end of which is connected with the forward end of the pertinent separator strip 30 and the other end of which is connected with a retaining cross-piece 160 of the separator head 32. The foremost cross-bar 154' is connected through connecting pieces 155 with the side walls 46.

In order to facilitate the threading in of the leading end of a new set 14 the separator plates 138 are staggered forwards and upwards in the transport direction A. The plate 144 from which the four upper cover strips 140 issue is also inclined, forming an introduction slope. The four cover strips 140 issuing from the plate 144 extend exactly above the separator strips 30 and the lower cover strips 140. The forward ends of the upper cover strips 140 are again guided over two cross-bars 162 and 164 and finally secured under initial stress through helical tension springs 166 to a further transverse rod 168. Referring to FIGS. 1 and 5 it should be remarked in this context that the distance between the individual layers of the set 14 or of the severed set piece 24 and corresponding the distance between the strips 30 and 140 is shown greatly enlarged in order to clarify the assembly and manner of function of the device according to the invention. Also the invention is not limited to 3-layer sets 14; there may be more or less layers.

Between the transport roller pairs 72 and 74 there is a double taper roller shaft 170 which again extends horizontally transversely of the transport direction A and is mounted on the side walls 46 with eccentric pivot point. The double taper shaft 170 serves as perforation tearing aid. For this purpose it is provided with a total of five double taper rollers 172 which are distributed at equal distances from one another over the width of the set 14 to be severed rotatably or even fast in rotation on the double taper shaft 70. The double taper roller shaft 70 is pivoted with its rollers 172 so far from beneath into the transport path of the set 14 between the transport roller pairs 72 and 74 that when the set 14 is stretched between the roller pairs 72 and 74 the double taper rollers 172 generate a local upward bellying of the set 14. If at the same time one of the transverse perforations 26 is situated in this bellying region, this immediately leads to local tearing open of the perforation and then to a complete severance of the transverse perforation.

Now the principle of functioning of the device 10 according to the invention consists in causing the set 14 to be transported by the two transport roller pairs 72 and 74 with equal transport speeds until the transverse perforation next to the severed arrives in the region between the two transport roller pairs 72 and 74. Now the forward transport roller pair 74 is driven with higher speed than the transport roller pair 72, which leads to a correspondingly growing tension stressing of the length of the section 14 between the transport roller pairs 72 and 74, until finally, supported by the double taper roller shaft 170, the corresponding transverse perforation 26 tears open and then the individual layers of the torn-off set piece 24 are fed to the respective allocated reception boxes 36 to 40 (see also FIG. 1). After change-over to equal transport speeds of the transport roller pairs 72 and 74 this operation can be repeated as often as desired.

From the foregoing it can be seen that for the operational phase with equal transport speeds of the transport roller pairs 72 and 74 it is sufficient if the electric motor 106 acting directly upon the belt drive 107 is switched on with the magnetic coupling 130 switch off. For the subsequent operational phase with higher transport speed of the forward transport roller pair 74 it is merely necessary, with the electric motor 106 still running, to engage the magnetic coupling 130. Thereafter the shaft 80 rotates with double the speed of the shaft 76; the freewheel 120 is then overrun.

The actuation of the electric motor 106 and of the magnetic coupling 130 can take place through a control apparatus 174, represented in FIG. 2 as a small box. This apparatus is connected, through electric leads represented in dot-and-dash lines, with the corresponding electrical components of the device 10. Thus a lead 176 connects the control apparatus 174 with the electric motor 106; a lead 178 forms the connection of the magnetic coupling 130 with the control apparatus 174.

The control apparatus 174 can be directly connected with a data processing installation which prints the set 14, which is symbolised in FIG. 2 by an electric lead 180. Through this lead 180 the control apparatus 174 is informed when it has to carry out the speed change-over for the severance of the next transverse perforation 28.

However the device can also be laid out with simple means for automatic operation, which makes the device 10 especially suitable for use in what is called the average data technique.

For independent automatic operation it is essential that the control apparatus 174 works exactly in synchronism with the motion of the set 14. In order to achieve this a first detector 182 is provided which ascertains the position of the leading end of the set 14. The detector 182 consists for example of a light barrier arrangement which is arranged between the double taper roller shaft 170 and the forward transport roller pair 74 and measures the passing through of the leading end of the set 14 now newly formed after the tearing of the corresponding transverse perforation, when this leading end approaches the forward transport roller pair 74. The detector 182 consists of a light barrier emitter 184 lying for example above the transport path of the set 14 and of a light barrier receiver 186 placed beneath the transport path. Emitter 184 and receiver 186 are each fitted on a transverse rod 188. The positional signal delivered by the receiver 186 is fed through an electric lead 190 to the control apparatus 180.

In order, in a simple manner, to couple the controlling progress with the transport operation and the movement of the transport roller pairs 72 and 74, the already mentioned inductive pick-up 136 is provided which scans the slotted disc 132 rotating with the shaft 78 and delivers a corresponding signal through a lead 192 to the control apparatus 174.

In the case of independent operation of the device 10 the control apparatus 174 must be fed with information as to the set piece length to be torn off each time. For this purpose for example an input device 194 indicated in FIG. 2 can be connected through a lead 196 with the control apparatus 174. The input device 194 is provided for example with six input keys 197 which correspond to six different tear-off lengths. Furthermore a start and stop key 198 is provided.

After actuation of one of the input keys 196 and the start-stop key 198 the control apparatus 174 sets the electric motor 106 running. Thereupon the leading end of the set 14, which had previously been threaded by layers between the plates 138, 142 and 144, is conveyed by the pullers 48, driven in a manner not shown, to the rear transport roller pair 72 and finally entrained by this pair. As soon as the leading end of the set 14 runs through the light barrier of the detector 182, the corresponding signal fed through the lead 190 to the control apparatus 174 frees a counter 200 of the control apparatus 174 which thereupon counts up the pulses corresponding to the slot division of the disc, and emitted by the inductive pick-up 136. A comparator circuit (not shown) compares the counting state in each case with an ideal value which is smaller, by a predetermined small amount, than the product of the inserted tear-off length in inches and the number 6. When the counter 200 has reached the value the transverse perforation 28 to be torn off next is situated in the region between the rear transport roller pair and the double taper roller shaft 170. Now the control apparatus 174 engages the magnetic coupling 130 whereupon the transport speed of the forward roller pair 74 doubles. Since the transport speed of the rear roller pair 72 is unchanged, during the further transport a rapidly growing tension stress builds up which finally leads to the transverse perforation 28, which meanwhile has arrived on the double taper rollers 172, tearing apart. The torn-off set piece 24 is then conveyed onwards by the transport rollers 74 with either double or single transport speed and deposited, divided by layers, in the reception boxes 36 to 40. The counter 200 is reset so that the device 10 is ready for the severing of the next set piece.

It can be seen that to alter the tear-off length it is only necessary to press a different input key 197; the mechanical configuration, especially the distance b between the transport roller pairs 72 and 74, remains unchanged.

In some utilisation cases, as in continuation invoices or in the dividing up of a computer print-out to different subscribers (group separation), the print-out length (or form length) changes from set piece to set piece. In order to render possible a corresponding automatic severing of the set pieces with different tear-off lengths the device 10 is provided with a further detector 202 which reads off a marking 204 in the region of the leading end of each set piece indicating the tear-off length of this set piece. The marking 204 can for example be an optical marking (possibly bar code). However other markings, such as magnetic, also come under consideration. The detector 202 is secured to a cross-bar 205 between the rear transport roller pair 72 and the double taper roller shaft, above the transport path of the set 14. The detector 202 delivers its signals, indicating the tear-off length next to be considered, through a lead 206 to the control apparatus 174, which again converts these signals into an ideal value which is comparable with the counting state of the counter 200. The further progress of operation of the device 10 is the same as in the case of external input of the tear-off length through the input device 194. In FIG. 1 four set pieces 34*a* to 34*d* are already severed with different tear-off lengths a and deposited in the reception boxes 36, 38 and 40.

For the case where endless form sets 14' with interlayers, for example carbon paper interlayers 42, which are not reusable subsequently are used, the arrangement as represented in FIGS. 2 to 5 is also preceded by the removal device 44 already mentioned in connection with FIG. 4. This is explained in greater detail in FIG. 6. It consists of two pairs of pullers 208 and 210 arranged with spacing from one another in the transport direction A, and deflector plates 212 of strip form arranged between the puller pairs. Each deflector plate 212 lies between the under side of a printed layer 13 and the upper side of a carbon paper interlayer 42, forming a 45° angle with the transport direction A. Now each carbon paper interlayer 42 is laid around the forward edge 214, in the transport direction A, of the deflector plate 212 lying thereover, and conducted laterally outwards, in the plane of the arriving set 14', out of the set 14'. Next the interlayers 42 are deflected over deflector rollers 216 for example downwards and fed to a roll-up apparatus (not shown). In this way the carbon paper interlayers 42 can be guided laterally out, the set 14' being transported continuously in the direction A. The set 14' is hooked into the pullers 208 and 210 in such a way that the length situated in each case between the two puller pairs can be spread open sufficiently by the deflector plates 212.

We claim:

1. Device (10) for severing multi-layer sets (14; 14') of endless forms or the like provided with transverse perforations (28), with a tear-off arrangement (22) of two transporters arranged with spacing (b) from one another in the transport path of the set (14; 14'), the forward transporter in the transport direction (A) being drivable with higher speed than the rear transporter in order to generate, in the section of the set (14,; 14') situated between the transporters a tension stress causing the tearing of one of the transverse perforations (28), characterized in that between two successive layers (13) of the set (14) there are provided elongated separating members (30) which extend in the transport direction (A) between a rear securing point (138) behind the rear transporter and a forward securing point before the forward transporter.

2. Device according to claim 1, characterized in that the speeds of the selected transporters are in dependence upon the position of the transverse perforation (28) to be severed.

3. Device according to claim 2, characterised by a control device (174) for the reception of information as to the length of the set pieces (24) to be torn off and for the delivery of speed command signals to the forward and rear transporter.

4. Device according to claim 3, characterised by a first detector for the emission of a positional signal indicating the exact position of the set (14; 14') to the control device (174).

5. Device according to claim 4, characterised in that the first detector is arranged in the region between the perforation tearing point and the forward transporter and is formed to measure the passing of the leading end of the set (14; 14').

6. Device according to claim 5, characterised in that the first detector is formed by a light barrier (184, 186).

7. Device according to claim 4, characterised by a second detector (202) for reading off a marking (204) on the set (14) indicating the length of the next set piece to be torn off and for the emission of a corresponding severing length signal to the control device (174).

8. Device according to claim 7, characterised in that the second detector (202) is an optical marking reader.

9. Device according to claim 7, characterised by a third detector for the measurement of the momentary setting of the forward and rear transporters and for the emission of a corresponding setting signal to the control device (174).

10. Device according to claim 9, characterised in that the third detector is formed by an inductive pick-up (136) which explores a slotted disc (132) or the like running in synchronism with the drive shaft (76) of one of the transporters and preferably fitted fast in rotation on the drive shaft (76).

11. Device according to claim 10, characterised in that the spacing of the slotted disc corresponds to a transport length of 1/6 inch (25.4/6 mm.) each time.

12. Device according to claim 9, characterised in that the control device (174) comprises a counter (200) which, upon the positional signal, begins to count the setting signals, and also a comparator circuit which, on reaching of a counting state of the counter (200) which is predetermined or derived from the severing length signal, delivers to the forward and rear transporters a speed command signal effecting the severing.

13. Device according to claim 2 characterized in that the speeds of the two transporters are equal.

14. Device according to claim 2 characterized in that the speed of the forward transporter is higher than the speed of the rear transporter.

15. Device according to claim 2, characterised in that the two transporters are coupled with one another through two alternately engageable gears (107, 121) with different transmission ratios.

16. Device according to claim 15, characterised in that the gears (107) constantly couples the two transporters through a freewheel (120) and in that the second gear (121) is engageable according to the choice.

17. Device according to claim 16 characterized in that the second gear is engageable by means of a magnetic coupling (130).

18. Device according to claim 15, characterised in that one of the gears is a 1:1 gear and the other gear is an approximately 1:2 gear.

19. Device according to claim 18 characterized in that the first gear (107) is the 1:1 gear.

20. Device according to claim 16 or 18, characterised in that the control device (174) is connected with the magnetic coupling (130) for the emission of an engagement signal, forming the speed command signal, to the magnetic coupling (130).

21. Device according to claim 1, characterized in that said transporters are formed by transport roller pairs (72,74) which hold the set (14,14') between them, that at least one of the two transport rollers of each transporter extends only over a partial region of the set width perpendicularly of the transport direction (A), and in that the separator members (30) extend in the remaining region of the set width through the transporter.

22. Device according to claim 21, characterized in that at least one of the two transport rollers of each transporter is formed with a flattened part region (96) of the circumference.

23. Device according to claim 21, characterized in that said at least one transport roller of each pair of transport rollers (72,74) is divided into at least two partial rollers (84, 86, 88, 90,92,94) arranged spaced from one another, and that said elongated separating members (30) extend between said partial rollers (84,86,88,90,92,94).

24. Device according to claim 1, characterised in that the separator members (30) of strip form are subject to initial spring stress.

25. Device according to claim 24, characterised in that the forward fastening points of the separator members are formed by separator heads (32) which feed the individual layers (34*a* to 34*d*) of the severed set piece (24) to respectively allocated reception boxes (36, 38, 40).

26. Device according to claim 25, characterised in that on the separator heads (32) there are provided initial-stressing springs for the separating members (30) of strip form.

27. Device according to claim 1, characterised in that on at least one of the two sides of the set (14) a cover member (140) is provided which extends along the separator members (30).

28. Device according to claim 27 characterized in that the cover member (140) is of strip form.

29. Device according to claim 1, characterized in that in the region between the transporters there is provided a preferably eccentrically mounted perforation-tearing aid (170) with presser elements which press upon the set (14) under local loading.

30. Device according to claim 1, characterised in that before the two transporters there is provided a marginal strip removing device (18) for transport hole marginal strips (20) of the set (14).

31. Device according to claim 1, characterised in that before the two transporters there is provided a device (44) for conducting away interlayers arranged between successive layers (13) of the set (14').

32. Device according to claim 31, characterised in that the conducting-away device (44) comprises deflector plates (212) arranged between two pullers (208, 210), extending obliquely of the transport direction (A) and arranged between the layers (13, 42), the interlayers being laid around the deflector plates (212) and then guided laterally out of the set (14').

* * * * *